US008199074B2

(12) United States Patent
Wang et al.

(10) Patent No.: US 8,199,074 B2
(45) Date of Patent: Jun. 12, 2012

(54) SYSTEM AND METHOD FOR REDUCING MURA DEFECTS

(75) Inventors: Shou-Cheng Wang, Hsinchu County (TW); Shih-Chang Chang, Hsinchu County (TW)

(73) Assignee: Chimei Innolux Corporation, Miao-Li County (TW)

( * ) Notice: Subject to any disclaimer, the term of this patent is extended or adjusted under 35 U.S.C. 154(b) by 670 days.

(21) Appl. No.: 11/463,934

(22) Filed: Aug. 11, 2006

(65) Prior Publication Data

US 2008/0036703 A1 Feb. 14, 2008

(51) Int. Cl.
*G09G 3/30* (2006.01)
*G09G 3/32* (2006.01)

(52) U.S. Cl. ..... 345/76; 345/77; 345/78; 345/79; 345/83

(58) Field of Classification Search ..... 345/76–83, 345/691–693
See application file for complete search history.

(56) References Cited

U.S. PATENT DOCUMENTS 6,710,548 B2 3/2004 Kimura
6,911,781 B2 6/2005 Yamazaki et al.
6,987,496 B2 * 1/2006 Koyama et al. ..... 345/76
2005/0179625 A1 * 8/2005 Choi et al. ..... 345/76
2005/0275616 A1 * 12/2005 Park et al. ..... 345/102
2006/0103684 A1 * 5/2006 Yamazaki et al. ..... 345/690
2006/0256048 A1 * 11/2006 Fish et al. ..... 345/81

OTHER PUBLICATIONS

"An Improved Voltage Programmed Pixel Structure for Large Size and High Resolution AM-OLED Displays" Choi et al., 2004.
"A Novel Current Programmed Pixel for Active Matrix OLED Displays" Ohta et al, 2003.
Chinese language office action dated May 19, 2010.
English language translation of abstract of CN 1409404 (published Apr. 9, 2003).

* cited by examiner

*Primary Examiner* — Amr Awad
*Assistant Examiner* — Andre Matthews
(74) *Attorney, Agent, or Firm* — Thomas|Kayden

(57) ABSTRACT

A representative system for displaying images comprises a pixel array, a conversion circuit, a memory device, and a compensation circuit. The pixel array has a plurality of pixels, each having at least one organic light emitting element equipped with a sensing unit which retrieves display information when the organic light emitting element retrieves a test signal. The conversion circuit determines a display parameter of each organic light emitting element according to the test signal and the display information of each organic light emitting element. The memory device stores the display parameter of each organic light emitting element. The compensation circuit modifies a video signal in accordance with the display parameters stored in the memory device.

20 Claims, 6 Drawing Sheets

SYSTEM AND METHOD FOR REDUCING MURA DEFECTS

BACKGROUND OF THE INVENTION

1. Field of the Invention

The invention relates to organic light emitting diode (OLED) displays.

2. Description of the Related Art

OLED displays require no backlight, and are therefore optimum for thin formation, with no limitation of viewing angle. Thus, OLED displays have become popular substitutes for cathode ray tube (CRT) and liquid crystal display (LCD) devices.

One problem using organic light emitting elements is a mura defect, which is caused mainly by inconsistent luminance of the organic light emitting elements. Luminance of an organic light emitting element is determined in a manufacturing process and degrades with time. The rate of luminance decay of an organic light emitting element depends especially on characteristics of the organic light emitting element, conditions in a manufacturing process, how the organic light emitting element is driven, and other conditions.

Mura defects can be aggravated in full-color OLED display panels that emit red, green, and blue light. The organic light emitting elements of varying colors have different rates of luminance decay. The differences in luminance between the organic light emitting elements of a plurality of colors typically become more apparent with time.

FIG. 1 as disclosed in U.S. Pat. No. 6,710,548, depicts a display panel. A pixel array 102 of the panel has a plurality of pixels 104, each with an organic light emitting element 110. A video signal is written to the pixels by controlling a source line driver 106 and a gate line driver circuit 108. A current value (measured value) of total current through all pixels is measured by an ammeter 114. A correction circuit 116 controls a variable power supply 112 to compensate for the difference between the measured current and a reference value calculated from the video signal. Light emitted by the organic light emitting elements, however, cannot be corrected individually. Once the output of the variable power supply 112 is changed, driving signals (current or voltage) that drive the organic light emitting elements are all changed.

BRIEF SUMMARY OF THE INVENTION

Systems and methods for reducing mura defects are provided. In this regard, an embodiment of a system comprises a pixel array, a conversion circuit, a memory device, and a compensation circuit. The pixel array has a plurality of pixels, each having at least one organic light emitting element equipped with a sensing unit which retrieves display information of the corresponding organic light emitting element when the organic light emitting element is driven by a test signal. The conversion circuit determines a display parameter for each organic light emitting element according to the test signal and the display information of each organic light emitting element. The memory device stores the display parameter of each organic light emitting element. Based on the corresponding display parameters stored in the memory device, the compensation circuit modifies a video signal to drive the pixel array.

An embodiment of a method for reducing mura defects comprises: providing a plurality of sensing units manufactured in a pixel array, the pixel array having a plurality of pixels each having at least one organic light emitting element equipped with one sensing unit; providing organic light emitting elements with a test signal and retrieving display information of each organic light emitting element by utilizing the corresponding sensing unit; determining a display parameter of each organic light emitting element according to the test signal and the display information of each organic light emitting element; storing the display parameter of each organic light emitting element in a memory device; and modifying a video signal to drive the pixel array in accordance with the display parameters stored in the memory device.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

This description is made for the purpose of illustrating the general principles of the invention and should not be taken in a limiting sense. The scope of the invention is best determined by reference to the appended claims.

Figure 1:
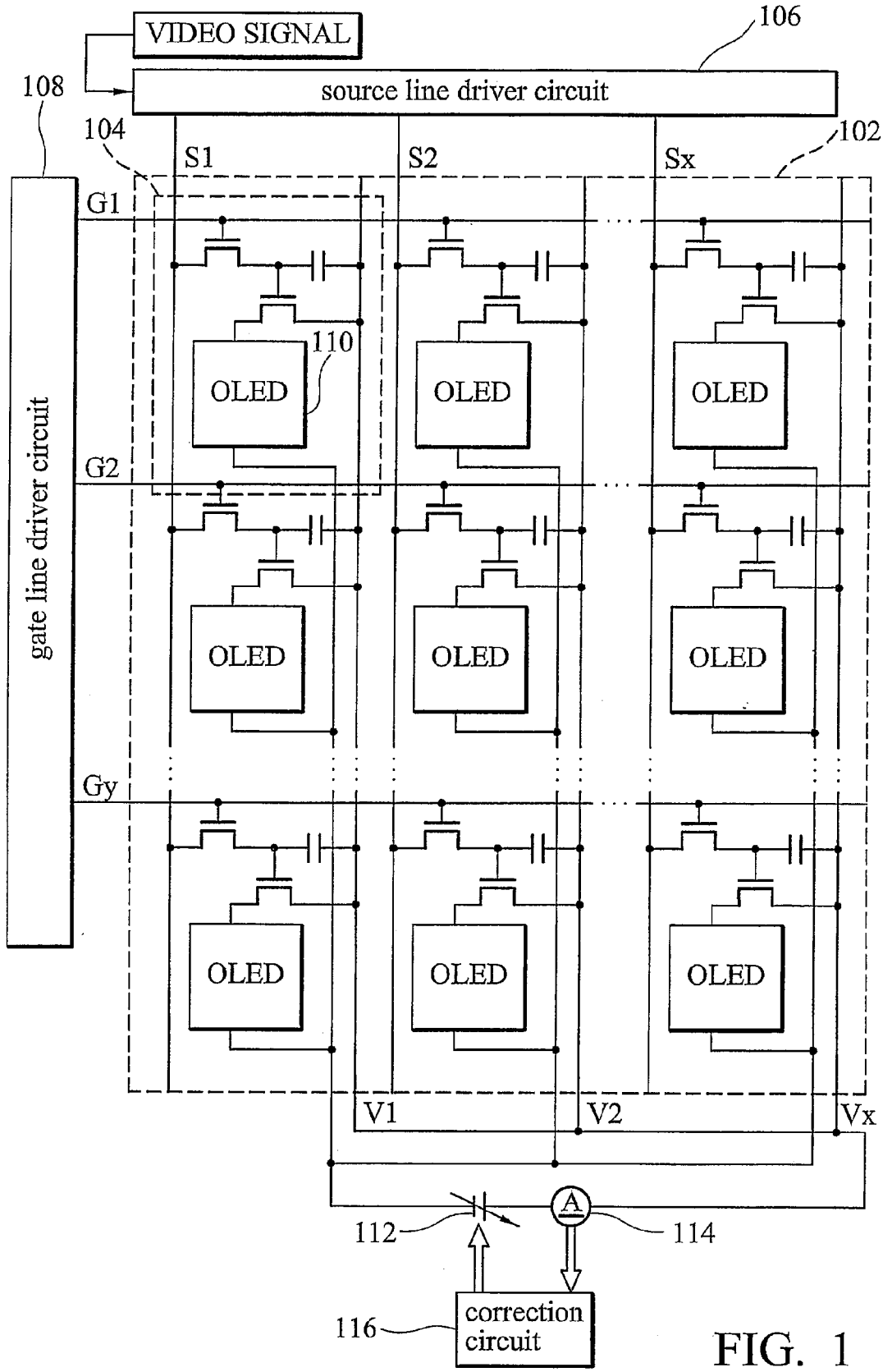
FIG. 1 shows a prior art display panel.
Figure 2:
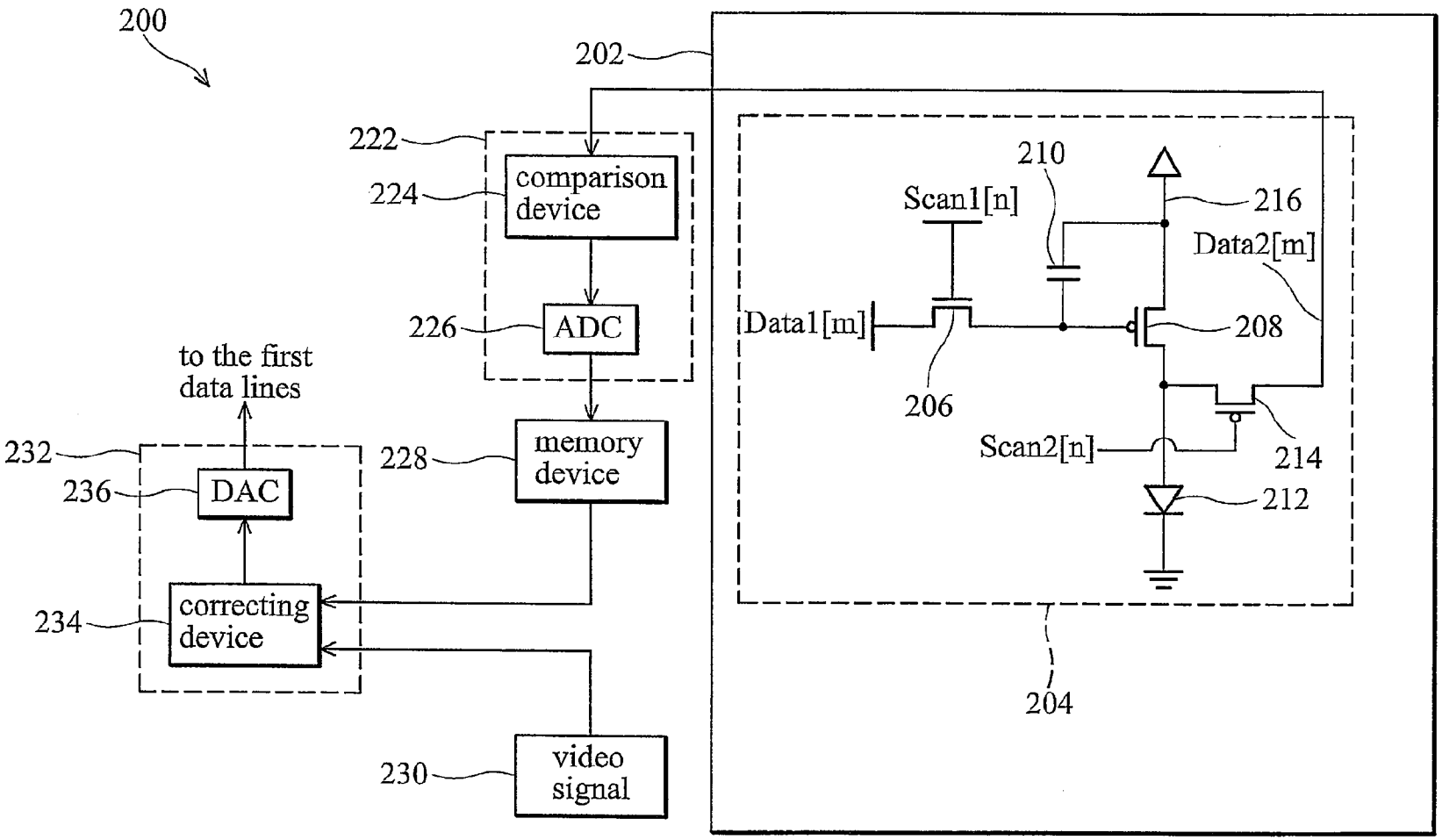
FIG. 2 is a block diagram depicting an embodiment of a system for reading mura defects.

FIG. 2 is a block diagram showing an embodiment of a system 200 for reducing mura defects. In this regard, system 200 incorporates a pixel array 202 that has a plurality of pixels. Only a single pixel 204, in the mth column of nth row of the pixel array, is shown in FIG. 2. The pixel 204 includes a switching thin film transistor (TFT) 206, a driving TFT 208, a storage capacitor 210, an organic light emitting diode (OLED) 212, and a sensing unit implemented as a TFT 214 (referred to as sensing TFT). The gate of the switching TFT 206 is connected to a first scan line Scan1[n], the source or drain is connected to the first data line Data1[m] and the other connected to the gate of the driving TFT 208. The source or drain of the driving TFT 208 is connected to a power source line 216 and the other to the anode of the OLED 212. The gate of the driving TFT 208 and the power source line 216 are connected to the storage capacitor. The source or drain of the sensing TFT 214 is connected to the anode of the OLED 212 and the other to a second data line Data2[m]. The gate of the sensing TFT 214 is connected to a second scanning line Scan2[n].

In a writing phase of a test mode, the switching TFT 206 is enabled by the first scanning line Scan1[n]. A test signal (e.g. a voltage value), is transmitted to the switching TFT 206 by the first data line Data1[m] and stored in the storage capacitor 210. Switching TFT 206 is then disabled by the first scanning line Scan1[n]. In a sensing phase of the test mode, current generated by the driving TFT 208 is based on the voltage value stored in the storage capacitor 210. The second scanning line Scan2[n] allows a branch current through the sensing TFT 214. The value of the branch current depends on a voltage value of the anode of the OLED 212 as well as a channel width-to-length ratio, mobility, and a threshold voltage of the sensing TFT 214. The second data line Data2[m] conveys the retrieved display information, the branch current or the voltage value of the OLED 212, to a conversion circuit 222 composed of a comparison device 224 and an analog-to-digital converter 226. The comparison device 224 generates a display parameter of the pixel 204 by comparing the retrieved display information with test information generated based on the test signal by assuming that electric characteristics of the pixel 204 are ideal. The analog-to-digital converter 226 converts the display parameter from analog to digital. The display parameter is stored in the memory device 228. The memory device 228 is implemented as a SRAM, a DRAM, a flash memory array, or other memory device that can store input data. The memory device 228 stores the display parameter of each of the pixels. The display parameters are redetermined as the system 200 receives a test command, each time the system 200 is turned on or operated for a period of time. In at least one embodiment, the first data line Data1[m] and the second data line Data2[m] are fabricated as one data line for conveying the test signal during the writing phase of the test mode and conveying the retrieved display information during the sensing phase of the test mode.

In at least one embodiment, the comparison device 224 determines the gray scale value of the OLED 212 based on the branch current retrieved by the sensing TFT 214. According to the test signal, a test gray scale value is generated for the OLED 212 by assuming electric characteristics of the OLED 212 are ideal. The comparison device 224 compares the gray scale value of the OLED 212 with the test gray scale value, and determines whether the OLED 212 requires more or less power to compensate for the brightness of the OLED 212, taken as a display parameter and stored in the corresponding cell in the memory device 228. To display an image without mura defect, the video signal 230 is modified by a compensation circuit 232, comprising a correcting device 234 and a digital-to-analog converter 236. Each pixel in the video signal 230 provides a voltage value. To modify the brightness of the pixel 204, the correcting device 234 decreases the voltage value as the corresponding display parameter stored in the memory device indicates that more power is necessary for the organic light emitting element in the pixel, and the correcting device 234 increases the voltage value as the corresponding display parameter stored in the memory device indicates that less power is necessary for the organic light emitting element in the pixel. The modified voltage values are converted from digital to analog by the digital-to-analog converter 236 and transmitted to the corresponding data lines.

Figure 3:
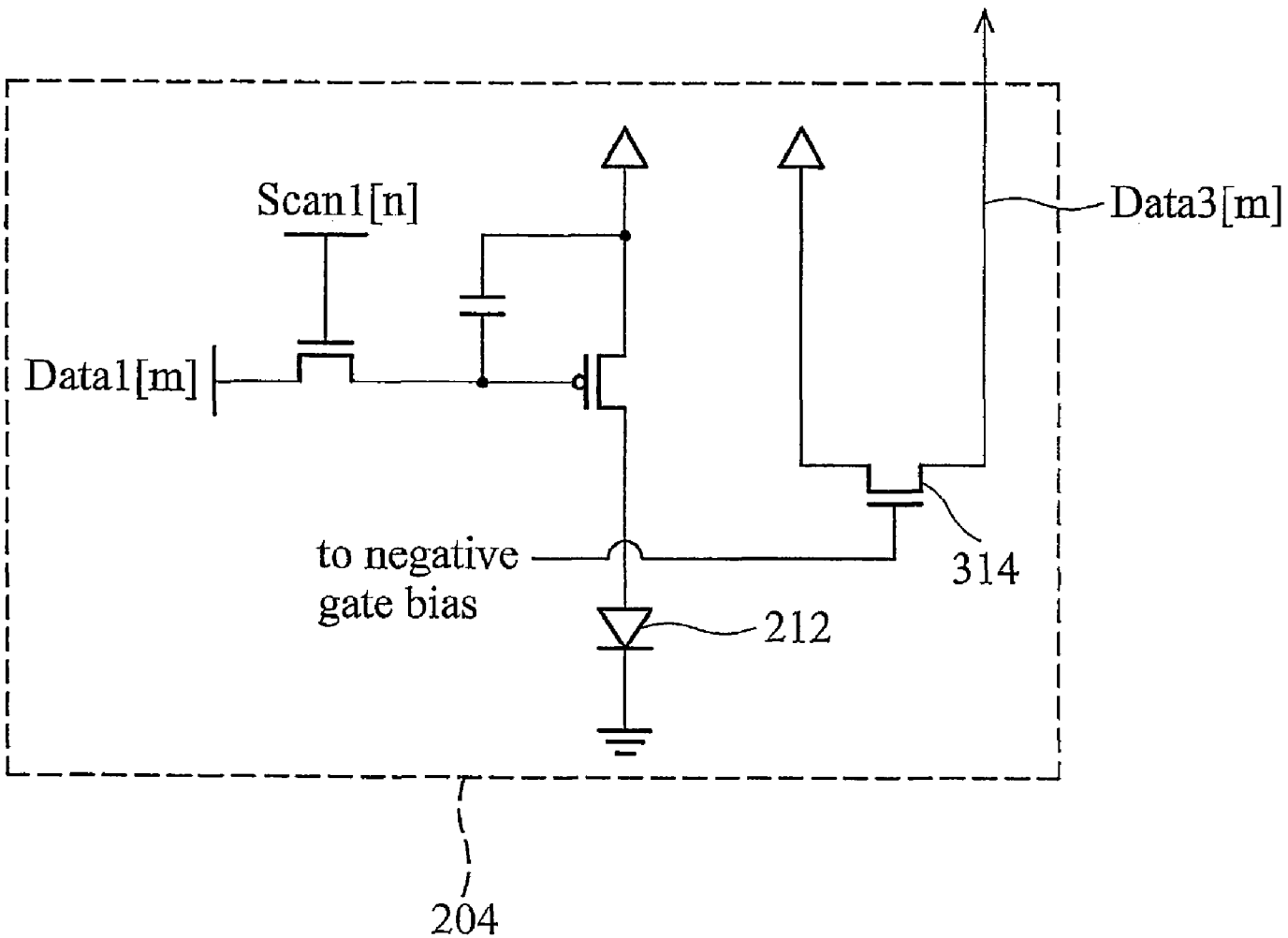
FIG. 3 is a schematic diagram showing detail of an embodiment of a pixel structure.

In FIG. 3, it is shown that a photo sensor 314 can substitute for the sensing TFT 214 in some embodiments. The photo sensor 314 is manufactured near the OLED 212 to detect photo current induced by light emitted from the OLED 212. In a test mode, OLEDs in the pixel array 202 are enabled to emit light singly, and the gate of each photo sensor 314 is connected to a negative gate bias to enable all photo sensors to detect the light. The photo current is transmitted to the comparison device 224 by a third data line Data3[m]. The photo sensor 314 may be implemented as a thin film transistor, a diode, a resistor or other electronic device, the electrical properties of which would change with the incident light.

Figure 4:
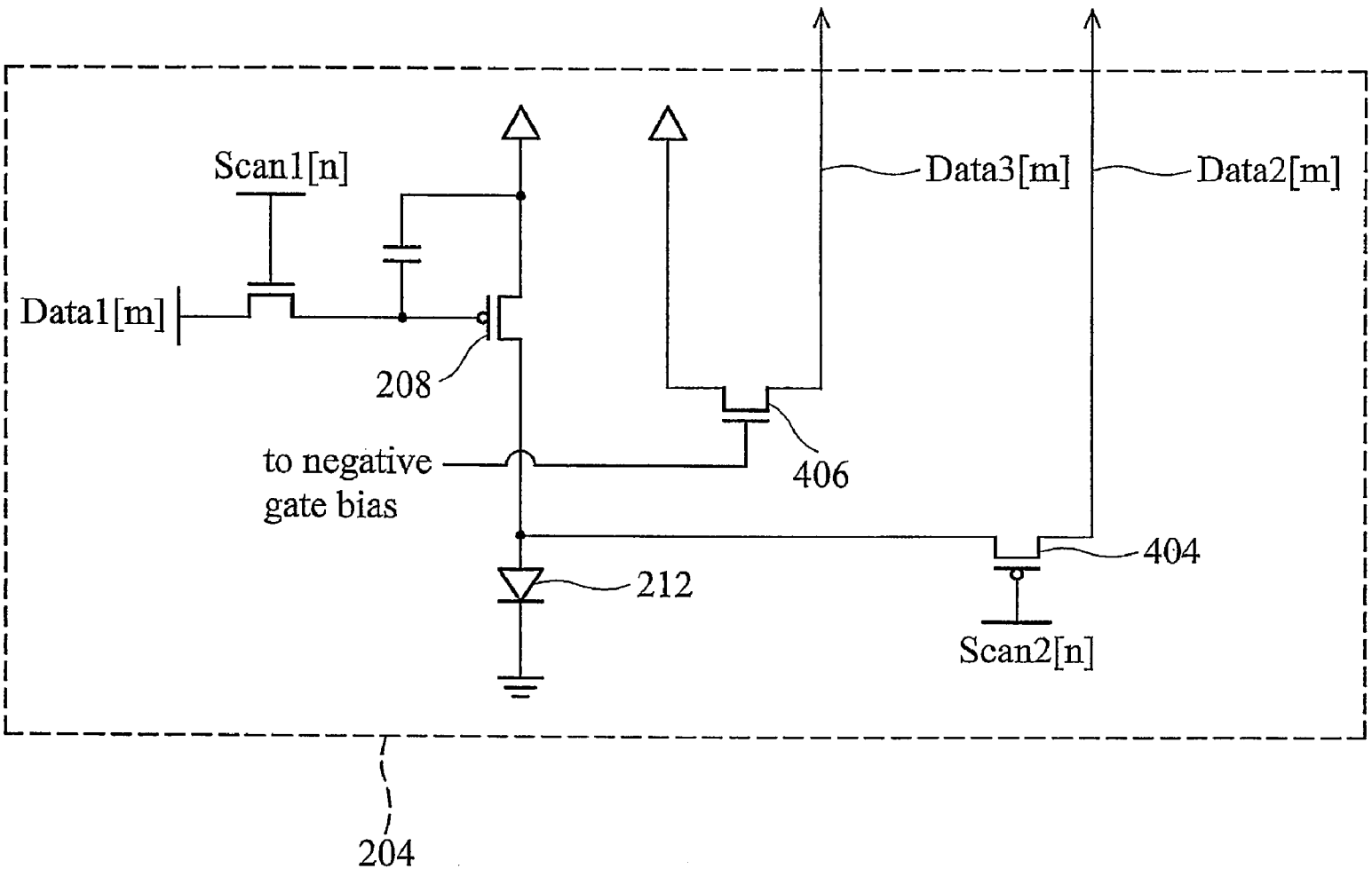
FIG. 4 is a schematic diagram showing detail of an embodiment of a pixel structure.

FIG. 4 shows an embodiment in which the sensing TFT 214 of FIG. 2 is replaced by a combination of a sensing TFT 404 and a photo sensor 406. The sensing TFT 404 is coupled to an OLED 212 to measure a branch of the current through the driving TFT 208 or a voltage between the electrodes of the OLED 212. The current or the voltage is transmitted to the comparison device 224 by the second data line Data2[m]. The photo sensor 406 detects a photo current induced by the light emitted from the OLED 212. The photo current is transmitted to the comparison device 224 by the third data line Data3[m].

If the display information retrieved by the sensing TFT 214 is a branch of the current through the driving TFT 208, test information signifying the ideal current through the driving TFT 208 is calculated by assuming that the OLED 212 is ideal and is written as the test signal. Based on the display information retrieved by the second data line Data2[m], the comparison device 224 calculates the actual current through the driving TFT 208. The comparison device 224 determines the display parameter of OLED 212 by comparing the ideal current through the driving TFT 208 with the actual current through the driving TFT 208.

Figure 5:
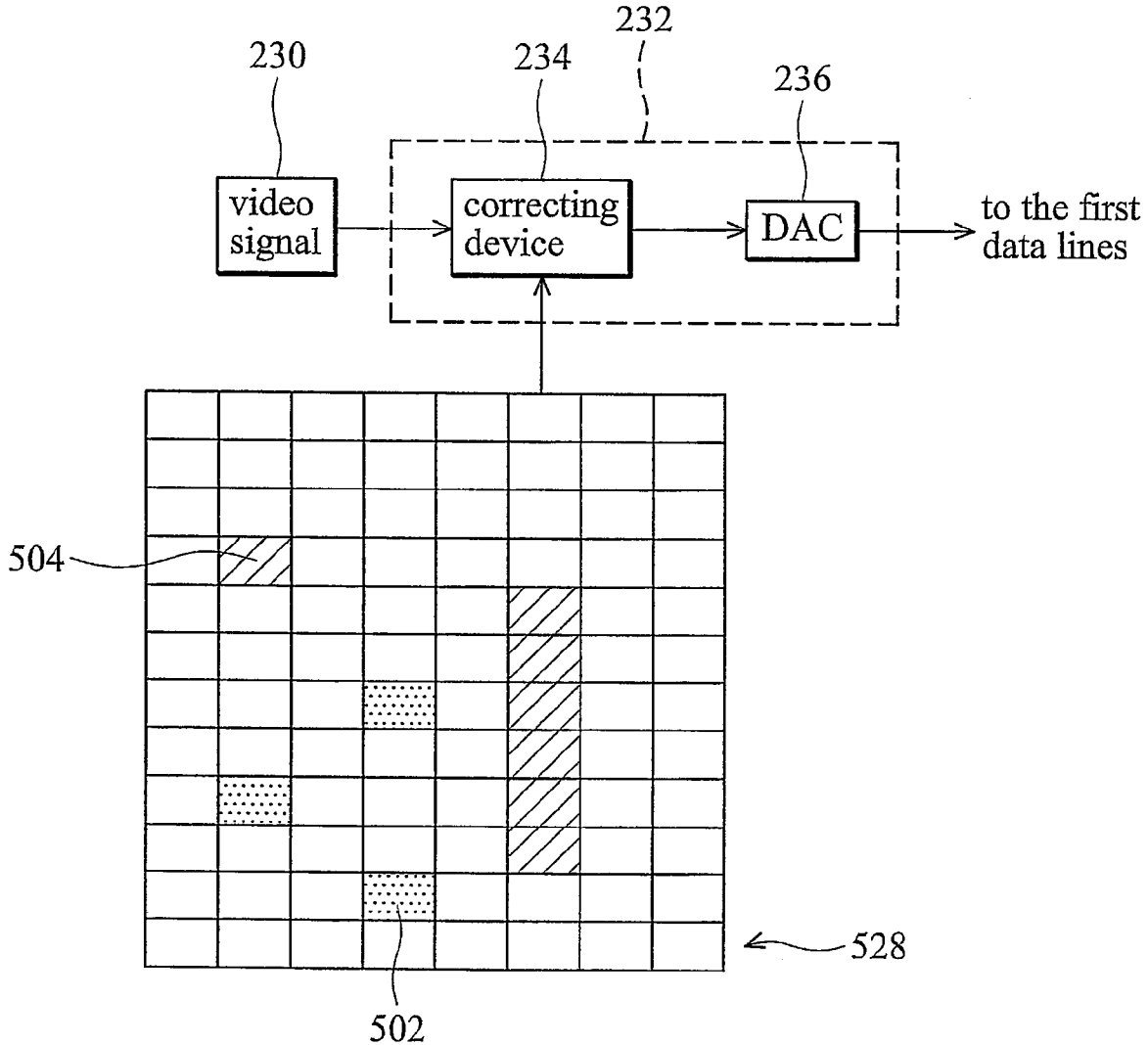
FIG. 5 shows display parameters stored in a memory device represented as a pixel mapping diagram.

FIG. 5 shows the display parameters stored in the memory device 228 represented as a pixel mapping diagram 528. The dotted block 502 indicates that more power is necessary to drive the corresponding OLED. Slashed block 504 indicates that less power is necessary to drive the corresponding OLED.

In at least one embodiment, a pixel array comprises a plurality of pixels to display full-color images, each pixel having a colored organic light emitting element emitting red, green, blue, and white light, respectively. The sensing unit may be equipped in the pixel having the shortest lifetime of organic light emitting element to reduce the complexity and the cost of the display array. In another embodiment, every pixel is equipped with a sensing unit. The conversion circuit, the memory device, and the compensation circuit for one color are different from the conversion circuit, the memory device, and the compensation circuit for other colors. The sensing units for different pixels share the same conversion circuit, memory device and compensation circuit in another embodiment.

In another embodiment, a system for reducing mura defects is provided that displays a static image. The compensation circuit of such a system generates a modified video signal of the static image. The modified video signal of the static image is stored in the memory device. The pixel array displays the static image by directly acquiring the modified video signal stored in the memory device. Therefore, circuits generating the video signal and the modified video signal of the static image can be turned off to save power after the video signal of the static image is stored in the memory device.

Figure 6:
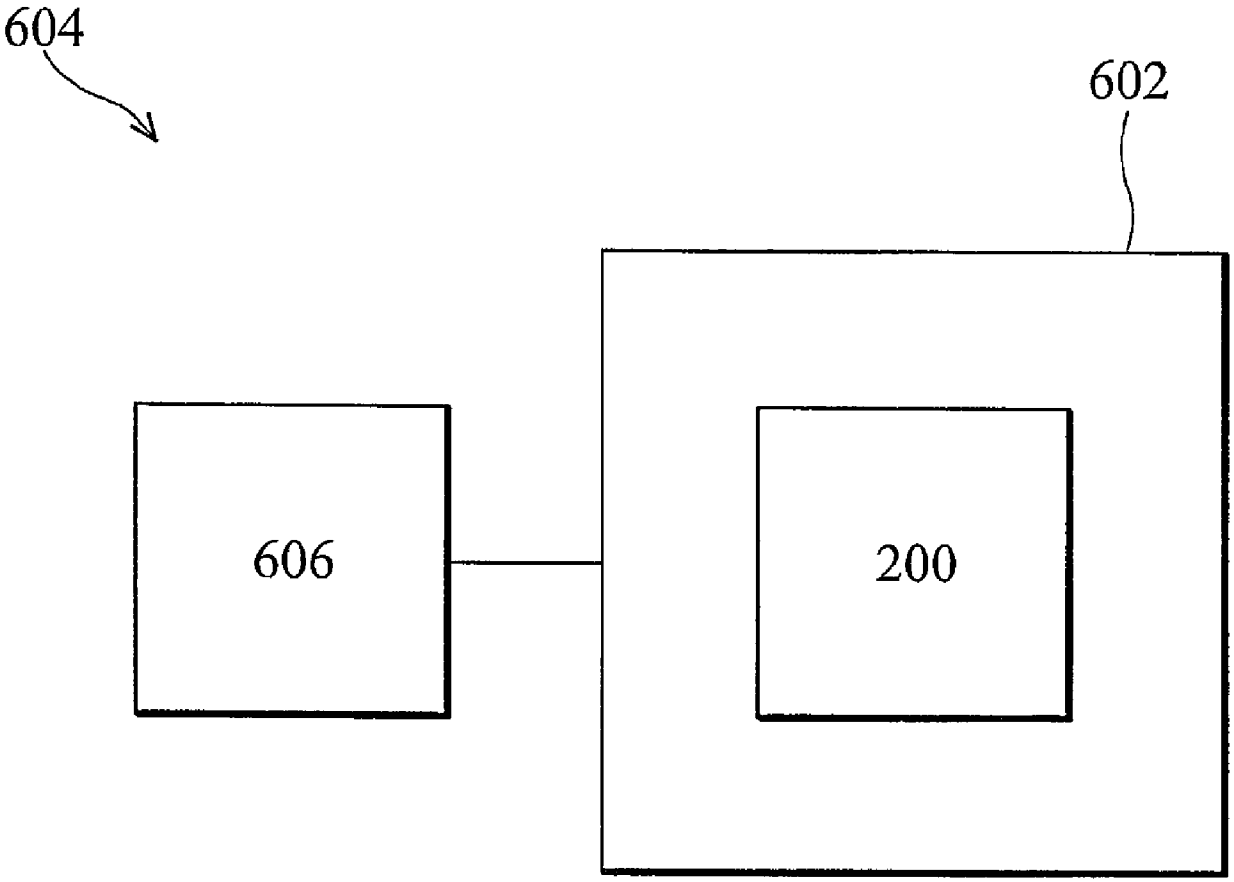
FIG. 6 schematically shows another embodiment of a system for reducing mura defects

FIG. 6 schematically shows another embodiment of a system for reducing mura defects, which, in this case, is implemented as a display panel 602 or an electronic device 604. The described system 200, for example, comprising the pixel array 202, the conversion circuit 222, the memory device 228 and compensation circuit 232, can be incorporated into the display panel 602 that can be an OLED panel. The display panel 602 can form a portion of a variety of electronic devices (in this case, electronic device 604). Generally, the electronic device 604 can comprise the display panel 602 and an input device 606. Further, the input device 606 is operatively coupled to the display panel 602 and provides the video signal 230 to the display panel 602 to generate images. The electronic device 604 can be a mobile phone, digital camera, PDA (personal digital assistant), notebook computer, desktop computer, television, car display, or portable DVD player, for example.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for reducing mura defects, comprising:

a pixel array comprising a plurality of pixels, each of the pixels comprising an organic light emitting element equipped with a sensing unit which is operative to retrieve display information responsive to the organic light emitting element when the organic light emitting unit emits according to a test signal, wherein the test signal is a fixed signal;

a conversion circuit operative to determine a display parameter of each organic light emitting element according to the test signal and the display information of each organic light emitting element, wherein the conversion circuit comprises:

a comparison device generating the display parameter according to the test signal and the display information of each organic light emitting element; and an analog-to-digital converter converting the display parameter from analog to digital;

a memory device operative to store the display parameter of each organic light emitting element; and a compensation circuit operative to modify a video signal to drive the pixel array in accordance with the display parameters stored in the memory device, wherein the compensation circuit comprises:

a correcting device modifying the video signal; and a digital-to-analog converter converting the modified video signal;

wherein the sensing units monitor real light of the organic light emitting elements to form the display information, wherein the pixel array further comprises:

a driving transistor comprising a gate, a first source and a first drain, wherein the first source or the first drain is connected to a power source line and the other to the organic light emitting element; and a switching transistor comprising a gate connected to a first scan line, a second source and a second drain, wherein the second source or the second drain is connected to a first data line and the other connected to the gate of the driving transistor, wherein the conversion circuit does not directly connect to the first data line; and wherein the sensing unit comprises a thin film transistor comprising a gate connected to a second scan line, a third source and a third drain, the third source or the third drain is connected to the organic light emitting element and the other to a second data line.

2. The system as claimed in claim 1, the first and the second data lines convey the test signals and the retrieved display information alternatively, wherein each organic light emitting element and the corresponding sensing unit share the same data line.

3. The system as claimed in claim 1, wherein:

each sensing unit further comprises a photo sensor;

the third source and the third drain of each of the thin film transistors is electrically connected to an anode of the corresponding organic light emitting element and the other outputs a current proportional to the current through the corresponding organic light emitting element or a voltage between the electrodes of the corresponding organic light emitting element as a portion of the display information;

each of the photo sensors retrieves a photo current induced by light emitted from the corresponding organic light emitting element to form another portion of the display information.

4. The system as claimed in claim 1, wherein the photo sensor is implemented by an electronic device, the electrical properties of which change with changes in incident light.

5. The system as claimed in claim 1, wherein, responsive to a test command, the system is operative to redetermine the display parameters.

6. The system as claimed in claim 1, wherein, responsive to the system being turned on, the system is operative to redetermine the display parameters.

7. The system as claimed in claim 1, wherein the system is operative to display a static image, wherein the memory device is operative to store a modified video signal generated by the compensation circuit to display the static image, in place of the display parameters.

8. The system as claimed in claim 1, wherein the pixel array further comprising a plurality of second pixels having longer lifetime organic light emitting elements but not equipped with sensing units.

9. The system as claimed in claim 1, further comprising a display panel, wherein the pixel array, the conversion circuit, the memory device, and the compensation circuit form a portion of the display panel.

10. The system as claimed in claim 9, further comprising an electronic device, wherein the electronic device comprises:

the display panel; and an input device coupled to the display panel and operative to provide the video signal to the display panel, such that the display panel displays images.

11. The system as claimed in claim 10, wherein the electronic system is a mobile phone, digital camera, Personal Digital Assistant, notebook computer, desktop computer, television, car display, or portable DVD player.

12. A method for reducing mura defects comprising:

providing a plurality of sensing units in a pixel array, the pixel array comprising a plurality of pixels each comprising an organic light emitting element, a switching transistor and a driving transistor;

providing the organic light emitting elements with test signals, wherein the test signals are fixed;

retrieving display information of each of the organic light emitting elements via corresponding ones of the sensing units;

determining a display parameter of each of the organic light emitting elements according to the test signal and the display information of each of the organic light emitting elements;

converting the display parameter from analog to digital;

storing the display parameter of each of the organic light emitting elements;

modifying a video signal to drive the pixel array in accordance with the display parameters stored, and converting the modified video signal from digital to analog;

wherein the sensing units monitor real light of the organic light emitting elements to form the display information, wherein the driving transistor comprises a gate, a first source and a first drain, the first source and the first drain is connect to a power source line and the other to the organic light emitting element, wherein the switching transistor comprises a gate connected to a first scan line, a second source and a second drain, the second source and the second drain is connected to a first data line and the other connected to the gate of the driving transistor, wherein the sensing unit comprises a thin film transistor comprising a gate connected to a second scan line, a third source and a third drain, the third and the third drain is connected to the organic light emitting element and the other to a second data line.

13. The method as claimed in claim 12, wherein each of the sensing units further comprises a photo sensor operative to retrieve a photo current, induced by light emitted from the corresponding organic light emitting element, to form the display information.

14. The method as claimed in claim 13, wherein retrieving of the display information of each organic light emitting element further comprises enabling the organic light emitting elements to emit light singly when all photo sensors are enabled to detect the light.

15. The method as claimed in claim 12 further comprising redetermining the display parameters when the system receives a test command, each time the system is turned on or as the system is operated for a period of time.

16. The method as claimed in claim 12 further comprising displaying a static image by storing the modified video signals with respect to the static image in the memory device in place of the display parameters.

17. The system as claimed in claim 1, wherein the third drain or the third source is electrically connected to an anode of the corresponding organic light emitting element and the other outputting a current proportional to the current through the corresponding organic light emitting element or a voltage between the electrodes of the corresponding organic light emitting element to form the display information.

18. The system as claimed in claim 1, wherein each sensing unit further comprises a photo sensor operative to retrieve a photo current as the display information, and the photo current is induced by light emitted from the corresponding organic light emitting element.

19. The system as claimed in claim 18, wherein, in a test mode, the organic light emitting elements are enabled to emit light singly, and all photo sensors are enabled to detect the light.

20. The method as claimed in claim 12, wherein the third drain or the third source is electrically connected to an anode of the corresponding organic light emitting element and the other outputting a current proportional to the current through the corresponding organic light emitting element or a voltage between the electrodes of the corresponding organic light emitting element to form the display information.

* * * * *